United States Patent [19]

Nagano et al.

[11] 4,045,279

[45] Aug. 30, 1977

[54] PROCESS FOR THE MANUFACTURE OF PULP USING SODIUM CARBONATE AND OXYGEN

[75] Inventors: Tadashi Nagano, Tokyo; Saisei Miyao; Katsuhiko Takeda, both of Kure, all of Japan

[73] Assignee: Toyo Pulp Co., Ltd., Tokyo, Japan

[21] Appl. No.: 722,000

[22] Filed: Sept. 9, 1976

Related U.S. Application Data

[63] Continuation of Ser. No. 534,347, Dec. 19, 1974, abandoned, which is a continuation-in-part of Ser. No. 317,685, Dec. 22, 1972, abandoned.

[30] Foreign Application Priority Data

Jan. 17, 1972 Japan ..... 47-6728

[51] Int. Cl.[2] ..... D21C 3/02

[52] U.S. Cl. ..... 162/25; 162/31; 162/40; 162/65; 162/90; 210/38 B; 210/42 R; 210/63 R

[58] Field of Search ..... 162/17, 19, 25, 31, 162/37, 40, 65, 90; 210/38 B, 42 R, 51, 52, 63 R; 423/24, 37, 139, 140; 241/15, 17, 18, 21, 27, 28

[56] References Cited

U.S. PATENT DOCUMENTS

| | | | |
|---|---|---|---|
| 2,904,460 | 9/1959 | Nolan | 162/25 |
| 2,913,362 | 11/1959 | Cusi | 162/25 X |
| 3,207,572 | 9/1965 | Saul | 162/31 X |
| 3,617,563 | 11/1971 | Fuxelius | 210/38 B |
| 3,691,008 | 9/1972 | Worster et al. | 162/25 |
| 3,701,712 | 10/1972 | Samuelson et al. | 162/65 |
| 3,790,370 | 5/1974 | Lalancette | 210/42 R X |

OTHER PUBLICATIONS

"Is Pulping Technology on Verge of Revolution?", Pulp & Paper, 7-1974, pp. 52-56.

*Primary Examiner*—Arthur L. Corbin
*Attorney, Agent, or Firm*—Wenderoth, Lind & Ponack

[57] ABSTRACT

A process for preparing pulp in a closed system by pre-cooking fibrous raw material in an alkaline aqueous solution of sodium carbonate or a mixture of sodium carbonate and sodium bicarbonate as the only alkaline ingredients at 90°-190° C, defibrating the pre-cooked material, pulping the defibrated material in an alkaline aqueous solution of sodium carbonate or a mixture of sodium carbonate and sodium bicarbonate as the only alkaline ingredients in a pressurized vessel at 90°-170° C in the presence of an oxygen-containing gas, subjecting waste liquor discharged from the pre-cooking and pulping steps to wet combustion to recover an alkaline aqueous substance and recycling the alkaline aqueous substance resulting from combustion to the pre-cooking and/or pulping steps.

5 Claims, 2 Drawing Figures

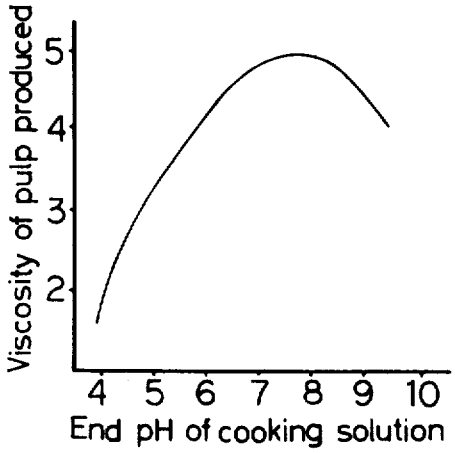
FIG.1
FIG.2
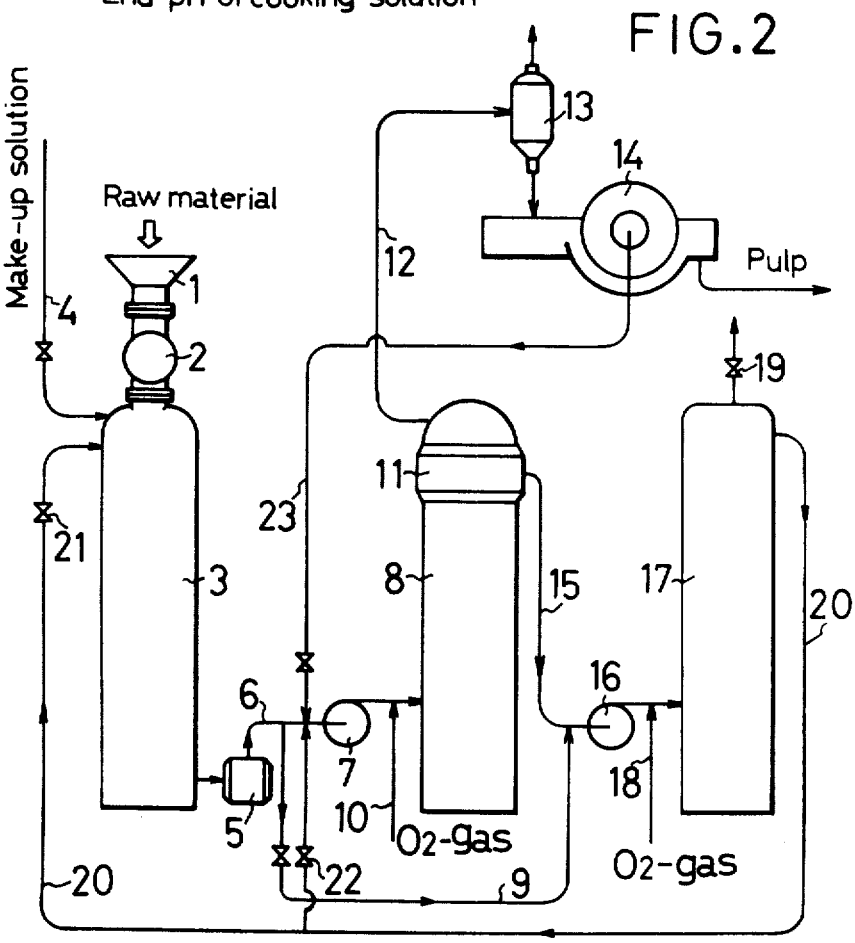

PROCESS FOR THE MANUFACTURE OF PULP USING SODIUM CARBONATE AND OXYGEN

This application is a continuation of Ser. No. 534,347, filed Dec. 19, 1974 now abandoned, which is a continuation-in-part of Ser. No. 317,685, filed Dec. 22, 1972, now abandoned.

This invention relates to a process for the manufacture of pulp by oxidizing a fibrous raw material using an oxygen-containing gas, and to a process for the manufacture of pulp in a closed system in which the pulping of the fibrous raw material is coupled with the recovery of the pulping chemicals.

In the conventional processes for pulping fibrous raw materials, sulfur compounds have been used as pulping chemicals or agents. Because of their excellent lignin-removing activity, use of sulfur compounds has been regarded as being indispensable. However, these sulfur compounds have caused various pollution problems. In order to solve such problems, attempts have been made to pulp fibrous raw materials by catalytic oxidative decomposition with oxygen, in the presence of non-sulfur sodium compounds. For instance, U.S. Pat. Nos. 2,673,148 and 2,926,114 disclose pulping processes using oxygen as a pulping agent. In these processes, wood chips are digested in an aqueous solution at a pH in the range of about 7 to 9 in an atmosphere of a pressurized oxygen-containing gas, it being necessary to maintain the pH of the solution within this range during the pulping reaction. This pH control may be accomplished by the use of a buffer in the solution, such as sodium carbonate or sodium bicarbonate, which is added to the cooking solution. The pH may also be maintained within the indicated range by the continuous addition throughout the cooking period of an alkaline material in quantities sufficient to neutralize the free acids formed throughout the cooking period.

In the Japanese Patent Official Gazette, Specification No. 46-3901, laid open to public inspection, is indicated to disclose a pulping process using sodium bicarbonate to control pH, and in which the pulping waste liquor is subjected to wet combustion using an oxygen-containing gas, to thereby oxidize organic substances contained in the waste liquor. In this process, organic substances are substantially decomposed to carbon dioxide and water, and a part of the carbon dioxide is reacted with an alkaline substance in the oxidized liquor to regenerate bicarbonate, the regenerated bicarbonate then being reused as a pulping agent. Also in this process, the alkaline aqueous solution acting as a pulping agent is buffered to a pH of 7 to 9 prior to its reuse.

In each of the above processes, the pulping conditions require that the pH be maintained within the range of 7 to 9. It seems reasonable to maintain the pH in the range of 7 to 9 because a violent action of oxidative decomposition by oxygen may occur outside this range. For this reason, it is necessary to select a pulping agent applicable to the process. More specifically, only sodium bicarbonate is practically applicable. Further, in the wet combustion of the waste liquor under conditions which can substantially decompose organic substances contained in the waste liquor to carbon dioxide and water, as disclosed in the Japanese Specification No. 46-3901, the sodium salts used as pulping agent are converted to sodium carbonate, and therefore, it is very difficult to recover the pulping agent in the form of pure sodium bicarbonate. For this reason, the Japanese specification proposes adjustment of the pH to 7 to 9 by absorbing carbon dioxide gas formed by decomposition of organic substances, and converting sodium carbonate to sodium bicarbonate by utilizing carbon dioxide gas.

From another practical point of view in pulping fibrous raw materials by an oxidizing treatment, there are some problems regarding the method of feeding fibrous raw materials into a pulping vessel in which the pulping reaction is carried out under a total pressure of about 30 $kg/cm^2$, when air is employed as the oxygen source. It is practically impossible to send fibrous raw materials in the form of chips or shreds continuously into such a highly pressurized pulping vessel.

U.S. Pat. No. 3,691,008 discloses a two-stage pulping process wherein wood chips are subjected to mild treatment with sodium hydroxide and the thus-treated material, after being defiberized, is subjected to a second treatment with sodium hydroxide in the presence of oxygen. This is an improvement of the so-called soda process. However, the present invention differs from the process disclosed in this patent in that whereas the sodium hydroxide employed in the latter process acts to delignify the cellulosic material, the sodium carbonate or mixture thereof with sodium bicarbonate used in the present invention acts only as a catalyst for delignification, which is accomplished with the use of oxygen.

The difference in lignin-removing activity between sodium hydroxide and sodium carbonate is clearly shown in the following experiment. Thus, Eucalypt wood (*E. globulus*) chips were cooked with these two chemicals separately in a laboratory autoclave under the following conditions: maximum temperature, 170° C; alkali charge, 15% as $Na_2O$; wood to liquor ratio, 1:5; and retention (reaction) time, 60 min. Resulting yield of cooked material and Kappa number (an indication of lignin remaining in the cooked material) are as follows:

| Chemical used | Yield, % | Kappa number |
|---|---|---|
| NaOH | 55 | 65 |
| $Na_2CO_3$ | 75 | 130 |

Therefore, it is apparent that in the process of the present invention, delignification is mainly accomplished by oxidative degradation of lignin with oxygen in the pulping stage, the sodium carbonate acting as a kind of catalyst therefor.

Additionally, whereas the chemicals recovered from the pulping step in U.S. Pat. No. 3,691,008 are mainly in the form of sodium carbonate, and it therefore becomes necessary to convert the sodium carbonate to sodium hydroxide before recycling of the recovered material, by the so-called causticization process, such conversion is unnecessary in the present invention since the precooking and pulping agents are sodium carbonate or a mixture thereof with sodium bicarbonate, and therefore the recovered sodium carbonate need not be converted to sodium hydroxide prior to recycling.

Furthermore, the use of sodium carbonate or mixture thereof with sodium bicarbonate in accordance with the present invention possesses the advantage of less deterioration in fiber quality and higher yield as compared with the use of sodium hydroxide.

U.S. Pat. No. 2,018,490 discloses a pulping process utilizing an alkaline chemical, e.g. sodium carbonate or sodium hydroxide, in combination with a soluble sulfite, e.g. sodium sulfite, as the pulping reagents. However, as will be subsequently pointed out, the use of such sulfur-containing compounds are strictly prohibited in accordance with the present invention.

It is an object of this invention to provide a process for the manufacture of pulp which is substantially free from pollution, using sodium carbonate and oxygen-containing gas.

It is another object of this invention to provide a simplified process for the manufacture of pulp useful for various purposes in which sodium carbonate, which is most easily recovered from the pulping waste liquor, can be directly used as a pulping agent, without effecting pH adjustment.

It is a further object of this invention to provide a closed system for the manufacture of pulp in which pulping of a fibrous material is carried out by catalytic decomposition using oxygen, and the pulping waste liquor is simultaneously subjected to combustion, e.g. wet combustion, to thereby recover the pulping agent.

Another object of this invention is to provide a process for the manufacture of pulp using oxygen, wherein a homogeneous cooking operation, as well as a reduction in cooking time and pressure are accomplished, by improving the effect of oxygen on the fibrous material.

It is a further object of this invention to provide a process for the manufacture of pulp having various degrees of cooking, wherein delignification is controlled only by the oxidative decompositive reaction of oxygen.

A still further object is to provide a process for the manufacture of pulp using oxygen, by which a fibrous material can be continuously fed into a highly pressurized pulping vessel.

Other objects and advantages of this invention will be apparent from the description given hereinbelow, and by reference to the drawings, in which:

FIG. 1 is a graph illustrating the relation between the end pH of the cooking solution and the viscosity of pulp produced, and FIG. 2 is a schematic diagram illustrating the series of steps for practicing this invention.

This invention is based on the finding that insofar as the pH of the cooking solution is maintained at 7 to 9 at the end of the pulping reaction, it is unnecessary to maintain the initial pH of the cooking solution at 7 to 9.

The pulping reaction was conducted with the use of a cooking solution having pH values adjusted within the range of 7 to 12 by employing caustic soda, sodium carbonate, sodium bicarbonate, etc., and the relation between the end pH of the cooking solution obtained in the pulping reaction and the viscosity of the resulting pulp was examined. Results are shown in the graph of FIG. 1. As is apparent from this graph, the viscosity of the resulting pulp is not related to the initial pH of the cooking solution, but depends only on the end pH of the cooking solution. It is also apparent that when the end pH of the cooking solution is within the range of 7 to 9, the highest viscosity is obtained. It is presumed that the attack of oxygen on the cellulose is accelerated as the removal of lignin proceeds, and so, in order to avoid the oxygen attack on cellulose and to obtain a pulp having a high viscosity, the end pH of the cooking solution must be maintained in the range of about 7 to 9 for obtaining a pulp having a high viscosity. When the pH of the cooking solution at the terminal stage of the reaction is below about 7, reduction of the viscosity is caused to occur by hydrolysis, and when the end pH of the cooking solution is above about 9, the random attack of oxygen on cellulose tends to occur even at the early stage of the pulping reaction, which adversely effects the pulp quality. Therefore, it is preferred that the end pH of the cooking solution be neither below about 7 nor above about 9. Even if the pH of the alkaline cooking solution is above 9 in the beginning of the pulping reaction, the alkaline substance is consumed for neutralizing organic acids formed during the pulping reaction, which results in reduction of the pH. Accordingly, the end pH of the alkaline cooking solution can be easily adjusted within the range of about 7 to 9 by employing suitable conditions of temperature, pressure and reaction time for the whole pulping system.

Based on the above-mentioned finding, a solution comprising sodium carbonate as the main ingredient is used as a cooking solution in the process of this invention.

Thus, in accordance with this invention, there is provided a process for the manufacture of pulp which comprises (1) mixing a fibrous raw material with an alkaline aqueous solution of sodium carbonate or a mixture of a major proportion of sodium carbonate and a minor proportion of sodium bicarbonate as the only alkaline ingredients, which alkaline aqueous solution is completely free of sulfite and sulfide compounds and sulfur-containing ions resulting from dissolution of said compounds, the amount of sodium carbonate or mixture of sodium carbonate and sodium bicarbonate being 5–20% by weight, as sodium oxide, based on the weight of the raw material, (2) pre-cooking the fibrous raw material in the alkaline aqueous solution at a temperature of 90° to 190° C, (3) defibrating the pre-cooked material by mechanical means, (4) removing a major proportion of the waste liquor, formed during the pre-cooking step, from the defibrated material, (5) pulping the defibrated material in an alkaline aqueous solution of sodium carbonate or a mixture of a major proportion of sodium carbonate and a minor proportion of sodium bicarbonate as the only alkaline ingredients, which alkaline aqueous solution is completely free of sulfite and sulfide compounds and sulfur-containing ions resulting from dissolution of said compounds, the amount of sodium carbonate or mixture of sodium carbonate and sodium bicarbonate being 5–20% by weight, as sodium oxide, based on the weight of the raw material, in a pressurized pulping vessel at a temperature of 90° to 170° C in the presence of an oxygen-containing gas, (6) discharging the waste liquor, formed during the pulping step, from the pulping vessel, (7) subjecting the waste liquor discharged from at least one of the pre-cooking and pulping steps to combustion to recover an alkaline aqueous substance containing sodium carbonate or a mixture of a major proportion of sodium carbonate and a minor proportion of sodium bicarbonate as the only alkaline ingredients and (8) recycling the recovered alkaline aqueous substance, without any chemical treatment thereof, to at least one of the pre-cooking and pulping steps.

During the wet combustion step, a minor amount of the sodium carbonate contained in the waste liquor may be converted to sodium bicarbonate by a chemical reaction which occurs during combustion. The present invention therefore encompasses the use of the resultant mixture of sodium carbonate and sodium bicarbonate in the pre-cooking and pulping steps.

It has been found that not only the reaction temperature and pressure, but also the area of contact of the fibrous material with oxygen, greatly influences the reaction. More specifically, it was found that the increase of the contact area accelerates the oxidative reaction, as a result of which the removal of lignin is smoothly attained, making control of the cooking degree easy, resulting in homogeneous cooking and reduction of the cooking time and pressure. Thus, it is apparent that this invention has great flexibility in controlling the cooking degree, and that it is also possible to produce various grades of pulp, from semi-bleached to corrugate medium.

A fibrous raw material shreded or ground into pieces by using only mechanical action would cause damage to the cellulosic fiber and deterioration of the quality of the resulting pulp. In order to avoid such disadvantages, in this invention, prior to pulping by oxygen, the fibrous raw material is pre-cooked at a high temperature in a pre-cooking solution containing sodium carbonate or a mixture thereof with sodium bicarbonate as the only alkaline ingredients, thereby softening an intermediate membrane of the fibrous material, consisting essentially of lignin. The fibrous material is then defibrated by mechanical means, such as a refiner, and the so treated fibrous material is forwarded to the pulping step.

Since the fibrous raw material is defibrated prior to the pulping reaction, as described above, it becomes possible to pump the defibrated fibrous material together with the cooking solution into the pulping vessel in which sufficient pressure is being applied. This further makes it easy to carry out the process of this invention continuously and in a closed system, as will be described below.

In the process of the present invention, the pulping chemical or agent may be recovered from the waste liquor discharged from both the pre-cooking and pulping steps by using a combustion treatment, e.g. wet combustion, as a chemical recovery step.

As described above, a solution comprising sodium carbonate as the main alkaline ingredient is used as a pre-cooking and also pulping agent in the process of this invention. This sodium carbonate is finally obtained in a stable form when the pre-cooking and/or pulping waste liquors are subjected to wet combustion, and it is usually recovered in the form of an aqueous solution. Although the thus recovered aqueous solution has, in general, a pH ranging from about 9 to 11, in this invention this solution can be reused directly as the cooking solution without conducting pH adjustment thereof.

Therefore, the pre-cooking and/or pulp waste liquors can be directly used by recycling them as the pre-cooking and/or pulp waste agents, merely by subjecting them to a combustion treatment. Furthermore, the liquid balance throughout the system can be readily maintained by feeding a small amount of soda and water, so as to compensate for the amount of liquor carried away with the pulp. Therefore, in this invention, the entire process, including the pre-cooking, pulping and chemical recovery steps, is greatly simplified, and it is also posible to conduct the process in a closed circuit system.

The recovered alkaline aqueous solution containing sodium carbonate as the main alkaline ingredient is fed back again into either or both of the pre-cooking and pulping steps.

The pre-treated material which has been defibrated by mechanical means is fed to the next pulping step together with the alkaline aqueous solution used in the pre-cooking step, and in this case, the amount of oxygen consumed in the pulping step increases depending on the organic substances dissolved in the used pre-cooking solution, i.e. waste liquor. Accordingly, it is preferred that a major part of the waste liquor is separated from the fibrous material and is directly forwarded to the chemical recovery step. If desired, it is also possible to separate the fibrous material from the pre-cooking solution and add the alkaline aqueous solution recovered from the chemical recovery step to this separated fibrous material.

The pre-cooking temperature, pressure and time for the process of this invention may be properly chosen for the desired degree of defibration. Generally, good results are obtained by carrying out the pre-cooking at a temperature of 90° to 190° C and a vapor pressure of 0–12 kg/cm$^2$ gauge for 10 to 90 minutes.

In this invention, at the step of pulping by catalytic decomposition of the fibrous material with an oxygen-containing gas, it is unnecessary to adjust the initial pH of the cooking solution to about 7 to 9, and the pulping solution recovered from the wet combustion of the pulping waste liquor can be used directly as the cooking solution.

Temperature and pressure conditions described in the past literature of oxygen-cooking processes may be broadly employed at the pulping step of the process of this invention. Preferably, the oxygen-cooking (pulping) is conducted at a temperature of 90° to 170° C, under an oxygen partial pressure of more than 3 kg/cm$^2$, e.g. 3–17 kg/cm$^2$ gauge. The cooking period may be properly chosen depending on the desired degree of pulping, but in general, the pulping is carried out for 15 to 120 minutes.

Sulfur-containing compounds used in the conventional kraft pulping processes, such as sulfide compounds, e.g. sodium sulfide and sodium hydrosulfide, and sulfite compounds, e.g. sodium sulfite, cannot be used in this invention. If such sulfur-containing compounds are used in the pulping process of this invention, sulfuric acid and sodium sulfate are formed at the pulping step, which transfers the pH of the cooking liquor to the acidic side at the early stage of the cooking period, making it impossible to continue pulping.

In this invention, it is preferred that the amount of the chemical added in the alkaline cooking solution is 5 to 20% by weight, as sodium oxide, based on the weight of the raw material.

The waste liquor which has been discharged from the pulping step and separated from the pulp by conventional procedures is then forwarded to the chemical recovery step, where organic substances contained in the waste liquor are decomposed by the combustion treatment. In this invention, the wet combustion is carried out under temperature and pressure conditions which are the same as those adopted in the conventional processes. In general, the wet combustion is accomplished at a temperature exceeding 230° C, preferably exceeding 300° C, under an oxygen-containing gas.

Pure oxygen, air, oxygen-enriched gas, etc., may be used in this invention as the oxygen-containing gas to be fed to the pulping and chemical recovery steps.

The liquor obtained from the chemical recovery step, in which organic substances have been substantially decomposed to carbon dioxide gas and water, is in the form of an aqueous solution essentially containing sodium carbonate as the main alkaline ingredient. It usually has a pH exceeding about 9. However, it can be directly recycled again to the pre-cooking and pulping steps without conducting any pH adjustment.

In the chemical recovery step of this invention, compounds of certain heavy metals such as copper, iron, cobalt and the like may be used in the wet combustion treatment to catalytically accelerate the oxidative decomposition of organic substances contained in the waste liquor.

On the other hand, such heavy metals are also considered to be contained in woods, as minor components, and tend to accumulate in the liquor during repeated circulation. Therefore, if such metals contaminate the cooking solution which is recovered by the wet combustion of the waste liquor, they will act as an oxidation accelerator so that the fibrous material is oxidized too excessively in the pulping reaction, and make the pulp quality extremely poor. It is therefore necessary to capture and recover the metals in the wet combustion system. The heavy metal recovering treatment is preferably conducted by, for example, adsorbing the metal ions on a cation-exchange resin or by precipitating the metal ions as their sulfides.

By employing the heavy metal recovering treatment in the wet combustion system, the entirely closed pulping process of this invention can be realized.

An instance of the process of this invention will now be described by reference to the flow sheet shown in FIG. 2. Wood chips stored in hopper 1 are fed to pre-cooking digester 3 by means of feeder 2. An alkaline pre-cooking solution is added from lines 4 and 20 connected to the pre-cooking digester 3. The alkaline liquor, comprising sodium carbonate as the main ingredient, which has been recovered from wet combustion vessel 17, is supplied from line 20, and an aqueous solution of sodium carbonate is added from line 4 for the purpose of make-up. Chips, pre-cooked and softened in the pre-cooking digester 3, are then fed to disc refiner 5 where the fibrous material is defibrated. This defibrated material is fed under pressure through line 6 to pulping vessel 8 by means of pressure pump 7. When it is desired to separate a part of the pre-cooking solution from the defibrated material, the separated liquor is introduced directly to the wet combustion vessel 17 through line 9. In this case, the recovered alkaline aqueous solution is added to the defibrated material through the line 20 and valve 22, and they are both fed under pressure to the pulping vessel 8 through pressure pump 7. Further, in order to adjust the consistency in the feed to the pulping vessel, a dilute soda solution separated by washer 14 may be added to the feed through line 23, or the recovered alkaline aqueous solution may be introduced through the line 20 and valve 22. At the outlet of the pressure pump 7, an oxygen-containing gas is fed from line 10 to attain the pressure necessary for pulping. After the pulping, the pulp is separated from the cooking solution by means of heat diffusion screen 11 in the pulping vessel 8, which effects pre-washing of the pulp. The resulting pulp is passed through line 12 and blow cyclone 13 and then to the washer 14 where the secondary washing of the pulp is conducted. The waste liquor separated from the pulp by the heat diffusion screen 11 is fed under pressure to the wet combustion vessel 17 through line 15 by means of pressure pump 16. At the outlet of the pressure pump 16, an excess of the oxygen-containing gas is fed through line 18 to give the pressure necessary for wet combustion. Organic substances contained in the waste liquor are decomposed by the wet combustion, and resulting carbon dioxide gas is withdrawn from valve 19, or is recovered and utilized. The alkaline aqueous solution recovered from the wet combustion vessel 17 is recycled to the pre-cooking digester 3 through the line 20 and valve 21, and if necessary it is recycled to the pulping vessel 8 through the valve 22.

The following examples are given by way of illustration only, and the scope of this invention is not limited by these examples.

EXAMPLE 1

An aqueous solution of sodium carbonate was added to 200g of chips of Lodgepole pine in an amount, as sodium oxide, of 15% based on the weight of the wood, and pre-cooking was conducted at a temperature of 160° C for about 30 minutes at a liquor/wood ratio of 10. Then, the treated chips containing the pre-cooking solution were roughly defibrated to fiber bundles composed of 1 to about 10 fibers by means of a disc refiner.

The defibrated chips containing the pre-cooking solution were put into an autoclave without supplying a cooking solution, and the autoclave was sealed. Pulping was then conducted at a temperature of 160° C under a total pressure of 80 kg/cm$^2$ for 60 minutes by employing air, following which 2 liters of the waste liquor was separated from the pulp and subjected to the wet combustion treatment at a temperature of 300° C under a total pressure of 130 kg/cm$^2$ for 60 minutes with the use of air. The recovered solution had a pH of 10.3.

The results were as follows:

| | |
|---|---|
| Yield of pulp | 45% (unbleached) |
| Roe number | 4.5 |
| Relative viscosity | 6.0 |
| Burst factor | 5.2 |
| Breaking length | 7.5 Km |
| Tear factor | 98 |
| Density | 0.78 g/cm$^3$ |

EXAMPLE 2

The recovered solution obtained in Example 1 was used as the pre-cooking solution, and pulping was carried out under the same conditions as adopted in Example 1 to obtain the following results:

| | |
|---|---|
| Yield of pulp | 45% (unbleached) |
| Roe number | 4.6 |
| Relative viscosity | 6.1 |
| Burst factor | 5.1 |
| Breaking length | 7.3 Km |
| Tear factor | 92 |
| Density | 0.78 g/cm$^3$ |

EXAMPLE 3

Using the same procedure as in Example 1, defibrated chips containing the pre-cooking solution were obtained. From the defibrated fibrous material, a major portion of the pre-cooking soluton was separated. Sodium carbonate solution was supplementarily added to the defibrated fibrous material containing the remaining portion of the pre-cooking solution, in an amount, as sodium oxide, of 5% based on the weight of the wood. Then pulping was carried out by the same procedure as that of Example 1 to obtain a pulp having a Roe number of 4.6 and relative viscosity of 6.2

EXAMPLE 4

An alkaline aqueous solution of sodium carbonate was added to Western hemlock chips in an amount, as sodium oxide, of 20% based on the weight of the wood, and pre-cooking was conducted in an autoclave at 170° for 60 minutes. Then, the chips containing the pre-cooking solution were treated with a disc refiner to defibrate them into fiber bundles composed of 1 to 10 fibers, following which a major portion of the pre-cooking solution was separated from the defibrated fibrous material. Then sodium carbonate solution was added to the defibrated fibrous material containing the remaining portion of the pre-cooking solution in an amount, as sodium oxide, of 8% based on the weight of the wood, and pulping was carried out under an oxygen partial pressure of 8 and 12 kg/cm² gauge at 140° C for a cooking period of 60 minutes by employing pure oxygen to obtain the following results:

| | Run 1 | Run 2 |
|---|---|---|
| Oxygen partial pressure (kg/cm²) | 8 | 12 |
| Yield (%) of screened pulp | 45.8 | 44.7 |
| Yield (%) of rejects | 1.0 | 1.2 |
| Roe number | 5.4 | 4.4 |
| Relative viscosity | 7.8 | 7.0 |

EXAMPLE 5

The pre-cooking solution separated from the defibrated fibrous material in Run 2 of Example 4, together with the waste pulping liquor from Run 2 1 of Example 4, were mixed and subjected to wet combustion at a temperature of 320° C. The solution recovered from the wet combustion contained sodium carbonate as the main ingredient. A small portion of supplementary sodium carbonate was added to the recovered solution, and pre-cooking and pulping were carried out in the same manner as in Example 4, using an oxygen partial pressure of 12 kg/cm² gauge to obtain a screened pulp having a Roe number of 5.4 at a yield of 44.5%, rejects being 1.5%.

EXAMPLE 6

In order to produce pulp having the brightness of a semi-bleached pulp, pulping was carried out in the same manner and under the same conditions as in Example 4, except for employing a pulping time with oxygen of 120 minutes, instead of 60 minutes, and an oxygen pressure of 12 kg/cm² gauge to obtain: Yield of screened pulp, 42.2%, Roe number, 1.8; Brightness, 45.3% (G.E.).

We claim:

1. A process for the manufacture of pulp in a closed system, which comprises 1. mixing a fibrous raw material with an alkaline aqueous solution of sodium carbonate or a mixture of a major proportion of sodium carbonate and a minor proportion of sodium bicarbonate as the only alkaline ingredients, which alkaline aqueous solution is completely free of sulfite and sulfide compounds and sulfur-containing ions resulting from dissolution of said compounds, the amount of sodium carbonate or mixture of sodium carbonate and sodium bicarbonate being 5 - 20% by weight, as sodium oxide, based on the weight of the raw material,
2. pre-cooking the fibrous raw material in the alkaline aqueous solution at a temperature of 90° to 190° C,
3. defibrating the pre-cooked material by mechanical means,
4. removing a major proportion of waste liquor, formed during the pre-cooking step, from the defibrated material,
5. pulping the defibrated material in an alkaline aqueous solution of sodium carbonate or a mixture of a major proportion of sodium carbonate and a minor proportion of sodium bicarbonate as the only alkaline ingredients, which alkaline aqueous solution is completely free of sulfite and sulfide compounds and sulfur-containing ions resulting from dissolution of said compounds, the amount of sodium carbonate or mixture of sodium carbonate and sodium bicarbonate being 5 - 20% by weight, as sodium oxide, based on the weight of the raw material, in a pressurized pulping vessel at a temperature of 90° to 170° C in the presence of an oxygen-containing gas,
6. discharging waste liquor, formed during the pulping step, from the pulping vessel,
7. subjecting the waste liquor discharged from at least one of the pre-cooking and pulping steps to wet combustion, in which the waste liquor is treated at a temperature exceeding 230° C in the presence of an oxygen-containing gas, to recover an alkaline aqueous substance containing sodium carbonate or a mixture of a major proportion of sodium carbonate and a minor proportion of sodium bicarbonate as the only alkaline ingredients and
8. recycling the recovered alkaline aqueous substance, without any chemical treatment thereof, to at least one of the pre-cooking and pulping steps.

2. The process according to claim 1, wherein after the defibration of the pre-cooked material, a major proportion of waste liquor formed during the pre-cooking step is separated from the defibrated material, the alkaline aqueous substance recovered from the wet combustion treatment is added to the defibrated material and pulping of the defibrated material is carried out.

3. The processs according to claim 1, wherein heavy metals contained in the recovered alkaline aqueous substance are removed from the substance after the wet combustion treatment by adsorbing the metal ions on a cation-exchange resin or by precipitating the metal ions as their sulfides.

4. The process according to claim 1, wherein after defibration of the pre-cooked material, a major proportion of waste liquor formed during the pre-cooking step is separated from the defibrated material, a supplementary alkaline aqueous solution of sodium carbonate as the only alkaline ingredient, which alkaline aqueous solution is completely free of sulfite and sulfide compounds and sulfur-containing ions resulting from dissolution of said compounds, is added to said defibrated material and pulping of said defibrated material is carried out.

5. The process according to claim 1, wherein the entire amount of the alkaline aqueous solution employed in the pulping step is present in admixture with the defibrated material before commencing the pulping step.

* * * * *